US008800743B2

(12) United States Patent
Berger et al.

(10) Patent No.: US 8,800,743 B2
(45) Date of Patent: Aug. 12, 2014

(54) SAFETY BRAKE FOR AN ESCALATOR OR A MOVING WALKWAY

(71) Applicant: Inventio AG, Hergiswil (CH)

(72) Inventors: Michael Berger, Konigstetten (AT); Robert Schulz, Vienna (AT); Michael Matheisl, Wiesengasse (AT); Thomas Illedits, Neufeld (AT); Werner Eidler, Gollersdorf (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 13/940,387

(22) Filed: Jul. 12, 2013

(65) Prior Publication Data

US 2014/0014464 A1 Jan. 16, 2014

(30) Foreign Application Priority Data

Jul. 13, 2012 (EP) ..... 12176419

(51) Int. Cl.
*B66B 23/02* (2006.01)

(52) U.S. Cl.
USPC ..... 198/322; 198/330; 198/832.2

(58) Field of Classification Search
USPC ..... 198/322, 323, 330, 832.2, 832.3
See application file for complete search history.

(56) References Cited

U.S. PATENT DOCUMENTS

| | | | | | |
|---|---|---|---|---|---|
| 768,191 | A | * | 8/1904 | Patterson | 104/178 |
| 984,586 | A | * | 2/1911 | McQueen | 74/576 |
| 1,530,478 | A | * | 3/1925 | Carlson | 198/832.2 |
| 2,259,366 | A | * | 10/1941 | Dunlop | 198/323 |
| 2,460,017 | A | * | 1/1949 | Lautrup et al. | 188/69 |
| 2,873,848 | A | * | 2/1959 | Steinmetz | 198/832.2 |
| 3,871,514 | A | * | 3/1975 | Hewitt et al. | 198/810.02 |
| 4,175,727 | A | * | 11/1979 | Clarke | 254/274 |
| 5,277,278 | A | * | 1/1994 | Mehlert et al. | 188/70 B |
| 5,346,046 | A | * | 9/1994 | Peters | 192/142 A |
| 5,895,193 | A | * | 4/1999 | Ung | 414/327 |
| 2010/0252377 | A1 | * | 10/2010 | Lazar et al. | 188/74 |
| 2013/0112526 | A1 | * | 5/2013 | Makovec et al. | 198/323 |

FOREIGN PATENT DOCUMENTS

| | | | |
|---|---|---|---|
| CN | 202 138 945 | U | 2/2012 |
| FR | 735 676 | A | 11/1932 |
| JP | 2008 001470 | A | 1/2008 |
| JP | 2012 012187 | A | 1/2012 |

* cited by examiner

*Primary Examiner* — Leslie A Nicholson, III
*Assistant Examiner* — Keith R Campbell
(74) *Attorney, Agent, or Firm* — Ladas & Parry LLP

(57) ABSTRACT

A safety brake of an escalator or moving walkway includes at least one locking member, which is arranged so as to adopt a release setting or locking setting by means of a pivot movement. The locking member in the locking setting engages in at least one moved part of the escalator or the moving walkway and blocks this. In addition, the safety brake comprises a linear guide by which the locking member is linearly guided between a first position and a second position. The linear guide is mounted on a stationary part of the escalator or the moving walkway by a pivot axle.

17 Claims, 5 Drawing Sheets

SAFETY BRAKE FOR AN ESCALATOR OR A MOVING WALKWAY

CROSS-REFERENCE TO RELATED APPLICATION

This application claims priority to European Patent Application No. 12176419.5, filed Jul. 13, 2012, which is incorporated herein by reference.

FIELD

The disclosure relates to a safety brake for an escalator or for a moving walkway.

BACKGROUND

Safety brakes are used in emergency situations when due to technical problems or misbehavior of persons the step belt of the escalator or the plate belt of the moving walkway has to be rapidly stopped. In one example of a safety brake, the locking member or pawl is mounted to be pivotable about a pivot axis. The locking member is held by an actuating element in a release setting. As soon as the actuating element is activated, this pivots the locking member about the pivot axis into a locking setting so that the locking member engages in a moved part of the escalator or the moving walkway and blocks this. The moved part in which the locking member engages is usually a wheel rotatable about an axis of rotation. This can be, for example, a deflecting wheel of the step belt or a transmission wheel of a drive train connecting a drive motor with the step belt to be driven.

SUMMARY

At least some of the disclosed embodiments comprise a safety brake that can allow use secure against destruction.

Some embodiments comprise a safety brake of an escalator or a moving walkway having at least one locking member. The locking member can be pivoted between a release setting and a locking setting about a pivot axle, wherein the locking member in the locking setting engages in at least one moved part of the escalator or the moving walkway and blocks this or prevents further movement. In other words, the locking member is arranged in such a way as to adopt a release setting or a locking setting by means of a pivot movement, in which case the locking member in the locking setting engages in at least one moved part of the escalator or the moving walkway and blocks this. In addition, the safety brake comprises a linear guide by which the locking member is linearly guided relative to the pivot axle between a first and a second position. The linear guide is mounted by the pivot axle on a stationary part of the escalator or the moving walkway. The linear guide together with the locking member can thereby be pivoted or swiveled into place between the release setting and the locking setting.

The locking member mechanically positively engages in the moved part so that it can block this. Correspondingly, the moved part has profiles suitable for standing against the locking member when these impinge on the locking member. These profiles are usually projections and gaps which move with the moved part in a defined space. The defined space is, as it were, an envelope volume in which the projections move. As long as the locking member is held in the release setting it is disposed completely outside this defined space. If through pivotation of the linear guide about the pivot axle the locking member, which is linearly guided by the linear guide and pivots therewith, penetrates into the region of a gap in this defined space the locking member due to the further rotation of the moved part impinges on a projection and blocks or stops the moved part.

If now, as explained further above, the locking member in an intermediate position between the release setting and the locking setting impinges directly on a projection it stands against this and starting from the first position is pushed back along the linear guide to the second position until this impinged projection can move past the locking member. The linear guide and the locking member pivot further during this pushing back until an abutment is encountered. The locking member is pushed back by suitable means from the second position back into the first position and thus reaches the final locking setting. The moved part further moves or rotates until a projection following the impinged projection impinges on the locking member and is stopped by this.

In order to relieve the pivot axle of load the locking member has an abutment surface which in the locking setting is supported at the previously mentioned abutment, which is arranged at the stationary part. This abutment is arranged as close as possible to the moved part so that the bending moments which arise on impinging of the projection on the locking member are as small as possible.

In order to bring the locking member back again into the first position after pushing back from the second position a resilient element can be arranged between the pivot axle and the locking member. The resilient element positions the locking member relative to the pivot axle in the first position. As soon as the locking member is pushed from the first position in the direction of the second position the resilient element is stressed. This can be, for example, a spring element, a gas cylinder, a piece of elastomeric material or the like.

In order to accommodate and/or guide the resilient element and/or to protect it from damage the locking member can have a passage, a recess or a cavity in which the resilient element is arranged. The resilient element can also be arranged at the outer side of the locking member.

The linear guide can also be formed by a passage, for example a slot, arranged in the locking member. The linear guide can, moreover, open into the passage in which the resilient element is arranged.

The linear guide can also be arranged at an outer side of the locking member, for example in tubular form, wherein the locking member in the case of collision with a projection is pushed into the interior space of the linear guide created by the tubular form.

An actuating element, which pivots the locking member about the pivot axle from the release setting to the locking setting, is provided for actuation of the safety brake. A spring-loaded electromagnet, a pneumatic cylinder, a hydraulic cylinder, an electric motor, a servomotor or a setting motor, for example, can be used as actuating elements. Use is possibly made of a spring-loaded electromagnet, the armature of which in the case of power interruption drops out and pivots the locking member by the spring force of the spring-loaded electromagnet into the locking setting or swivels it into the defined space.

The actuating element can be incorporated in an electrical safety circuit which stands under voltage and comprises switching elements installed at safety-relevant locations of the escalator or the moving walkway such as, for example, in emergency stop buttons, in comb-plate or handrail-entry safety switches, and the like. As soon as the safety circuit is interrupted and the actuating element of the safety brake pivots the locking member a control of the escalator or the moving walkway detects this interruption and switches off the current feed of the drive motor. In order to ensure switching-off of the drive motor even more rapidly a switch can be provided which is actuable by the locking member and interrupts a current line of the drive unit of the escalator or the moving walkway.

At least one safety brake can be used in an escalator or in a moving walkway. The escalator or the moving walkway comprises, as stationary part, a support structure or framework with a first deflecting region and a second deflecting region. Belonging to the moved part are a first deflecting wheel pair rotatably mounted in the first deflecting region, a second deflecting wheel pair rotatably mounted in the second deflecting region and an endless step belt or plate belt, which is arranged between the two deflecting regions and is deflected by the deflecting wheel pairs. A deflecting curve having no moved parts can also be present in place of the first deflecting wheel pair. The safety brake is possibly fastened to the support structure in stationary position in one of the deflecting regions so that the locking member in the locking setting can engage at least in a deflecting wheel pair associated with the safety brake and can block this.

The two deflecting wheels of a deflecting wheel pair can be fixedly connected together by means of an axle or shaft. A collar with projections can be laterally arranged at one of the two deflecting wheels, in which case the locking member in the locking setting stands in the path of at least one of these projections. The projections can be blocks, teeth, pins or the like arranged at the collar. By virtue of the latter arrangement of the projections the pivot axle of the locking member can be arranged orthogonally to an axis of rotation of the deflecting wheel pair. This can mean that the entire safety brake can be accommodated in intermediate spaces, which are present in any case, of the support structure and a very direct force introduction of the braking forces into the support structure can be achieved.

When the locking member is pivoted and stands by its abutment surface against the stationary abutment a projection of the moved part, which is to be stopped, impinges on the locking member. In that case, the entire kinetic energy of the moved part would have to be abruptly nullified without further measures. This could have the consequence that the step belt or plate belt would stop abruptly and persons standing thereon could fall over and hurt themselves. In addition, the locking member would have to have large dimensions in order to be able to withstand the high impact force of the projection. In order to avoid all this, the collar can be arranged to be rotatable relative to the deflecting wheel, in which case a slip clutch is arranged between the deflecting wheel and the collar. A resilient element can obviously also be arranged between the collar and the deflecting wheel instead of the slip clutch or in combination therewith.

The slip torque of the slip clutch can be settable by way of the pressing force of the friction partners thereof. As a result, after engagement of the locking member only the collar with the projections is abruptly stopped and the rest of the moved part can run on under defined braking until at standstill. The slip torque of the slip clutch can, for example, be elastically set in accordance with a spring characteristic or in accordance with a progressive spring characteristic.

BRIEF DESCRIPTION OF THE DRAWINGS

The disclosed technologies are explained in more detail with reference to the drawings, in which.

DETAILED DESCRIPTION

Figure 1:
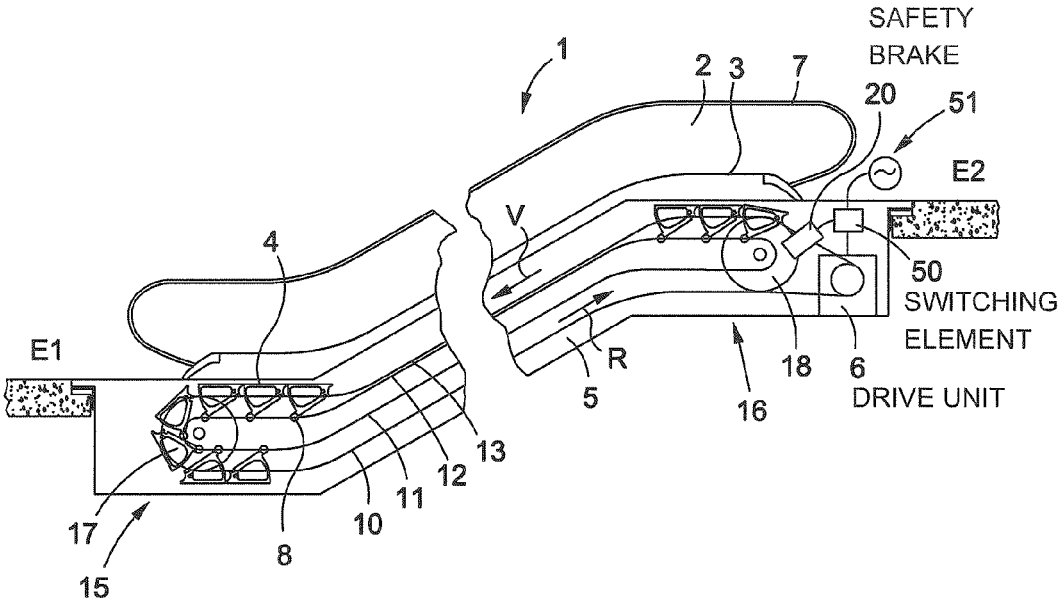
FIG. 1 shows, in side view in schematic illustration, an escalator with a support structure, in which guide rails and a circulating step belt are arranged between a first deflecting region and a second deflecting region.

FIG. 1 shows an escalator 1 with a balustrade 2 carrying a handrail 7. In addition, the escalator 1 comprises a support structure 5, which is illustrated in outline and which carries the balustrades 2. The balustrades 2 comprise base plates 3, between which laterally guided steps 4 are arranged to circulate. The escalator 1 connects a first story E1 with a second story E2. Guide rollers 8 of the steps 4 travel on guide rails 10, 11 or on guide rails 12, 13, which are connected with the support structure 5 of the escalator 1. Although FIG. 1 shows an escalator 1 with steps, at least some embodiments of the disclosed technologies are also suitable for a moving walkway with a plate belt. The support structure 5 can be a framework, a girder, a foundation and the like.

The steps 4 are connected together to form a circulating step belt. The framework 5 has in the region of the first story E1 a first deflecting region 15 and in the region of the second story E2 a second deflecting region 16, in which the step belt is deflected between a forward run V and a return run R. On the basis of the indicated arrow direction of the forward run V and the return run R in the illustrated embodiment, users are conveyed from the second story E2 to the first story E1.

Operation of the escalator in the opposite direction is also possible. For deflecting of the step belt a first deflecting wheel pair 17 is rotatably arranged in the first deflecting region 15 and a second deflecting wheel pair 18 in the second deflecting region 16.

In the present embodiment the second deflecting wheel pair 18 is connected with a drive unit 6. The drive unit 6 can also be arranged at another location of the escalator 1 or the moving walkway and drive the step belt or plate belt.

In addition, arranged in the second deflecting region 16 is a safety brake 20 which can act on the second deflecting wheel pair 18 and the construction and function of which is described in connection with the further FIGS. 2 to 6. Accordingly, FIGS. 1 to 6 have the same reference numerals for the same parts.

The safety brake 20 can act on a schematically illustrated switching element 50 which can interrupt the energy supply of the drive unit 6. In the case of an electric drive unit 6 this switching element 50 can be a motor circuit breaker or a thyristor, which interrupts the current supply 51 of an electric motor of the drive unit 6.

Figure 2:
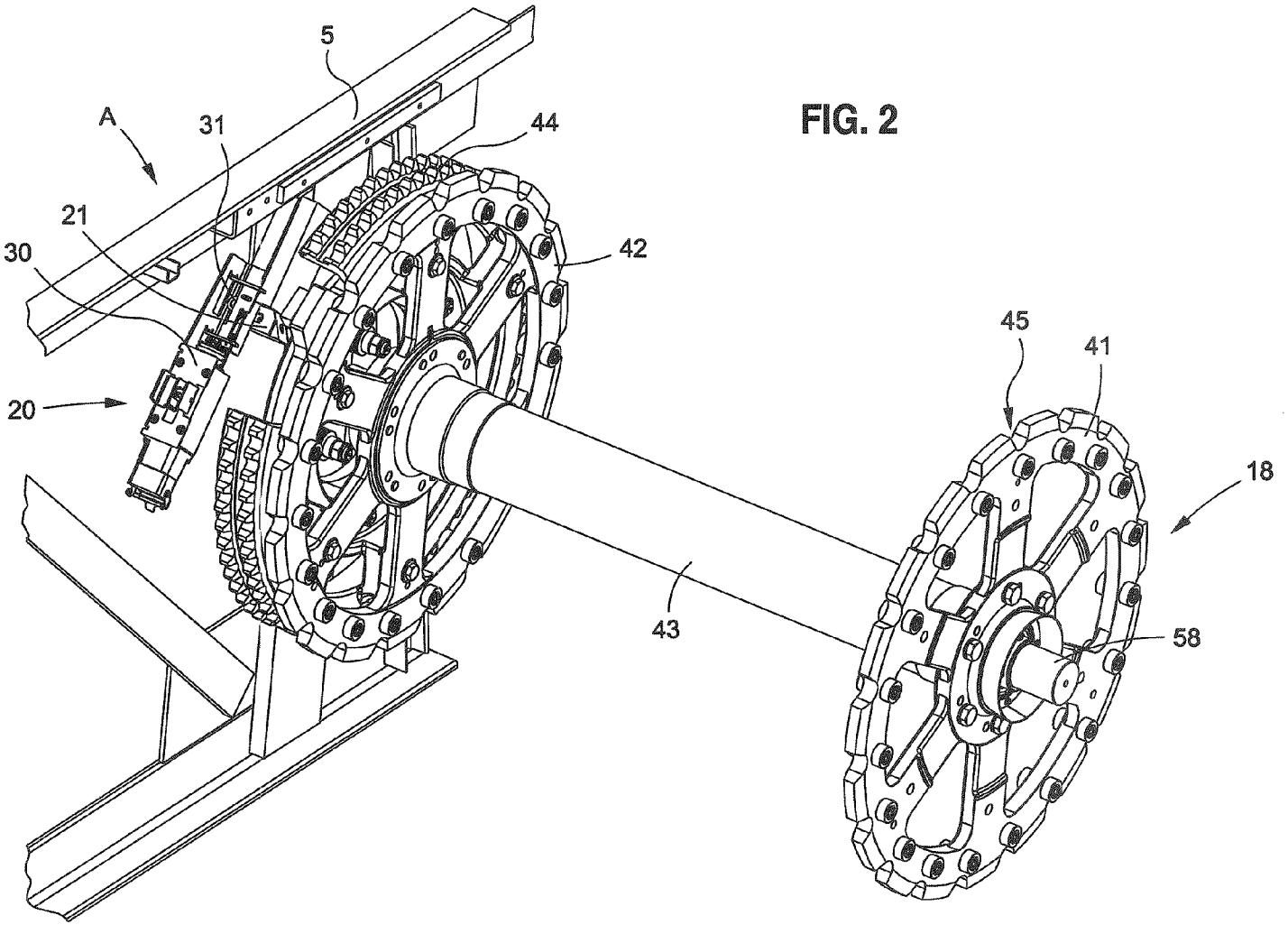
FIG. 2 shows, in three-dimensional view, a first deflecting wheel pair, which is illustrated in FIG. 1, of the first deflecting region with a part of the support structure and with a safety brake arranged at the support structure.

FIG. 2 shows the second deflecting wheel pair 18, which is illustrated only schematically in FIG. 1 and for the sake of better clarity only a small part of the support structure 5. The two deflecting wheels 41, 42 of the deflecting wheel pair 18 are connected with a shaft 43, which has bearing pins 58. The step belt or plate belt (not illustrated) is deflected by way of the two deflecting wheels 41, 42. In addition, the torque of the drive unit (not illustrated) is transmitted through the recesses 45, which are formed at the circumference of the deflecting wheels 41, 42, to suitable projections of the step belt, for example chain axles, chain pins, pins, bolts, rollers and the like. The bearing pins 58 are rotatably mounted in bearing locations (not illustrated) of the support structure 5.

In addition, a gearwheel 44 which is connected by means of a duplex chain (not illustrated) with the drive unit 6 illustrated in FIG. 1 is arranged on the shaft 43 laterally of one of the deflecting wheels 42. The gearwheel 44 and the mentioned duplex chain are referred to only by way of example and it is open to the expert to provide a different transmission of torque from the drive unit 6 to the second deflecting wheel pair 18. The gearwheel 44 is illustrated broken away at one place so that the most important parts of the safety brake 20 arranged on the support structure 5 can be seen.

The safety brake 20 is operated by means of an actuating element 30. In the present example, the actuating element 30 is an electromagnet. The actuating element 30 acts by way of a pivot lever 31, which is visible only partly, on a locking member 21 so that this can be pivoted from a release setting into the illustrated locking setting.

Figure 3:
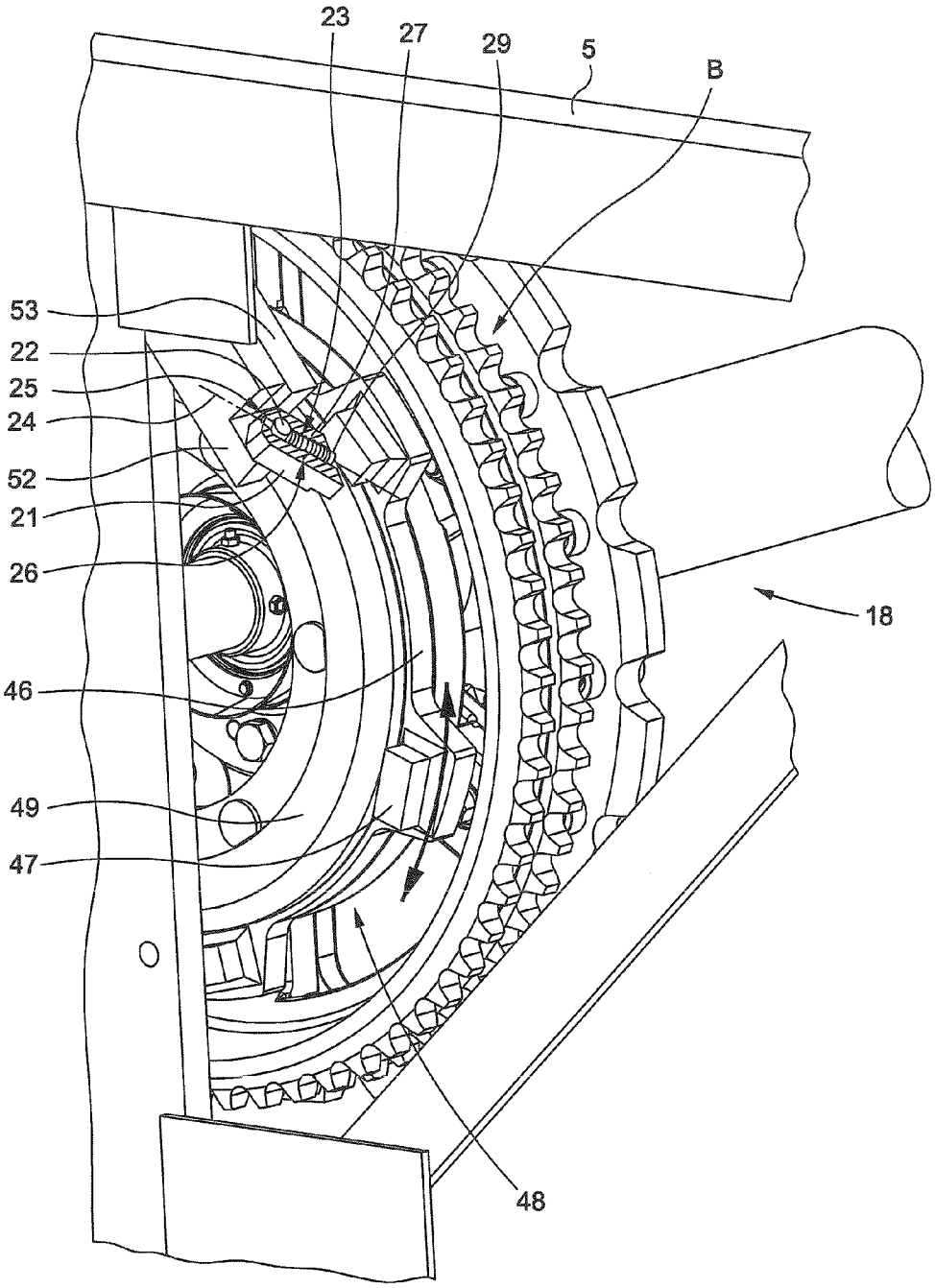
FIG. 3 shows a three-dimensional detail view of the deflecting wheel pair, which is illustrated in FIG. 2, from the viewing direction A indicated in FIG. 2.

FIG. 3 shows a three-dimensional detail view of the deflecting wheel pair 18 from the viewing direction A indicated in FIG. 2. For the sake of better clarity, the actuating element and the pivot lever, which acts on a pivot axle 22, are not illustrated. In addition, the locking member 21 is illustrated sectioned in a plane orthogonal to the pivot axle 22 so as to show the components arranged in the interior of the locking member 21.

The pivot axle 22 is pivotably mounted in a bearing arm 52, which is connected with the support structure 5 to be stationary with respect thereto. The locking member 21 has a linear guide 23, which is formed as a slot or elongate hole and which is arranged on the center longitudinal axis 24 of the locking member 21 and extends in the longitudinal direction thereof. The slot 23 extends only over a specific part of the locking member 21 and thereby defines a first position 25 and a second position 26, which the locking member 21 can adopt with respect to the linear displaceability thereof relative to the pivot axle 22. The pivot axle 22 is guided through the slot 23. The slot 23 as well as the first position 25 and the second position 26 can be seen substantially better in FIGS. 4 to 6.

The locking member 21 is illustrated in the release setting and through pivotation about the pivot axle 22 can mechanically positively engage in the deflecting wheel pair 18 and block this. Correspondingly, the deflecting wheel pair 18 has profiles which are suitable for standing against the locking member 21 when this is in the locking position and the profiles impinge on the locking member 21.

In the present example these profiles are created by a collar 46 with projections 47, which collar is connected with the deflecting wheel pair 18 and the projections 47 of which collar move in company with the deflecting wheel pair 18 in a defined, annular space 48. As long as the locking member 21 is held in the release setting it is disposed completely outside this annular space 48. When through pivotation or swiveling in of the linear guide 23 about the pivot axle 22 the locking member 21, which is linearly guided by the linear guide 23 and pivots therewith, penetrates into this defined space 48 and adopts the locking setting a projection 47 of the rotating deflecting wheel 18 constrainedly impinges on the locking member 21 and blocks or stops the deflecting wheel pair 18 and thus also the step belt or plate belt.

If it is now the case that the locking member 21 impinges on a projection 47 in an intermediate position between the release setting and the locking setting it stands against this projection and, starting from the first position 25, is pushed back along the linear guide 23 to the second position 26 until this impinged projection 47 can move past the locking member 21. The linear guide 23 and the locking member 21 pivot further during this pushing back, until the locking member 21 stands against an abutment 53, which is arranged in stationary position at the support structure 5. When the impinged projection 47 has further moved and a gap, which is present between the impinged projection 47 and the following projection 47, is disposed in the region of the pivoted locking member 21 the locking member 21 is pushed back by a resilient element 27 from the second position 26 again to the first position 25 and thereby attains the locking setting. The deflecting wheel pair 18 further moves or rotates until the projection 47 following the impinged projection 47 impinges on the locking member 21 and is stopped by this.

As already mentioned, the resilient element 27 positions the locking member 21 relative to the pivot axle 22 in the first position 25. As soon as the locking member 21 is pushed from the first position 25 in the direction of the second position 26 the resilient element 27, in the present embodiment a helical compression spring, is stressed. The resilient element 27 can, however, also be a gas cylinder, a hydraulic cylinder, a piece of elastomeric material or the like.

The resilient element 27 is arranged in the interior of the locking member 21 in a passage or in a bore, which is similarly arranged on the center longitudinal axis 24 of the locking member 21, extends over the longitudinal direction of the locking member 21 and opens in the slot 23. In order that the helical compression spring 27 remains at its predetermined location and can be mounted in simple manner, a plunger-shaped element 29 is guided through the helical compression spring 27 and arranged in the passage. The plunger-shaped element 29 is in addition displaceably arranged in a transverse bore of the pivot axle 22. The torque of the pivot lever 31, which is recognizable in part in FIG. 1, can thereby be transmitted to the locking member 21. In the present embodiment the plunger-shaped element 29 is a shank screw, wherein the shank thereof is concealed by the helical compression spring 27 and only the head thereof and the threaded end thereof screwed into the locking member 21 are visible in the region of the first position 25. The resilient element 27 or the helical compression spring bears at one end against the screw head of the plunger-shaped element 29 and at the other end against the pivot axle 22 and keeps, by the spring force thereof, the locking element 21 with respect to the pivot axle 22 in the first position 25.

In order to relieve the pivot axle 22 of load in the case of collision of the projection 47 with the locking member 21, the locking member 21 has an abutment surface which in the locking setting is supported at the stationary abutment 53. This abutment 53 is arranged, for example, as close as possible to the moved part or the collar 46, so that the bending moments, which arise when the projection 47 impinges on the locking member 21, are as small as possible.

When the locking member 21 is pivoted and a projection 47 of the deflecting wheel pair 18 to be stopped impinges on the locking member 21 the entire kinetic energy of the moved part would have to be abruptly nullified without further measures. This would have the consequence that the step belt or plate belt would abruptly stop. The persons standing thereon could fall over and in that case hurt themselves. Moreover, the locking member 21 would have to have enormous dimensions in order to be able to withstand the high impact force of the projection 47. In order to avoid all this, the collar 46 is arranged to be rotatable relative to the deflecting wheel pair 18. In addition, a slip clutch 49 is arranged between the collar 46 and the deflecting wheel pair 18, wherein, of the slip clutch 49, in FIG. 3 only a spring-loaded pressing ring is visible. The slip clutch 49 can have a slip lining, a brake lining, springs and the like. The collar 46 can also be a pinion or a disc.

The slip clutch 49 makes it possible, after engagement of the locking member 21 in the defined space 48, for only the collar 46 with the projections 47 to be abruptly stopped and the rest of the moved part, namely the first and second deflecting wheel pairs 17, 18 illustrated in FIG. 1 as well as the step belt composed of steps 4, to be braked in defined manner and to be able to run down to standstill.

Figure 4:
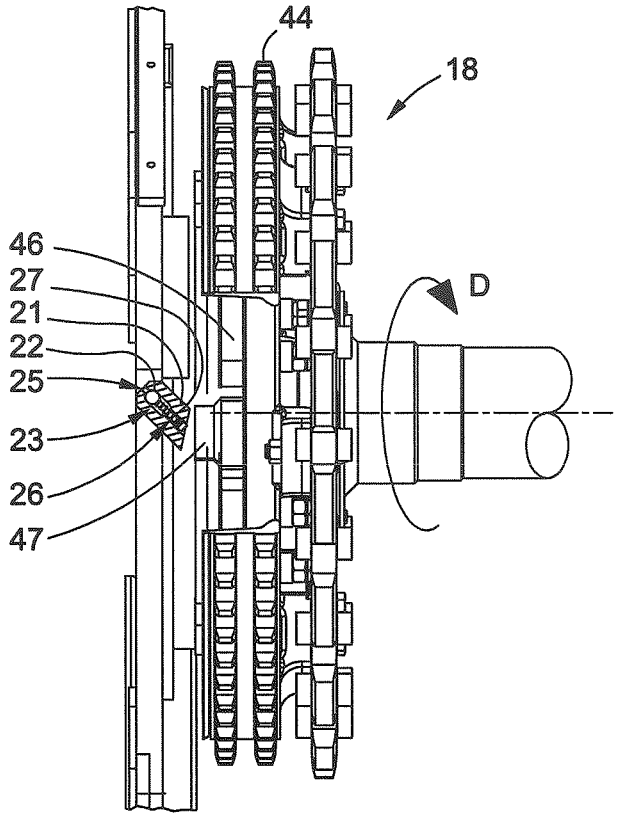
FIG. 4 shows a detail view, from the viewing direction B indicated in FIG. 3, of the deflecting wheel pair and the safety brake, wherein the locking member thereof is illustrated in the release setting.
Figure 5:
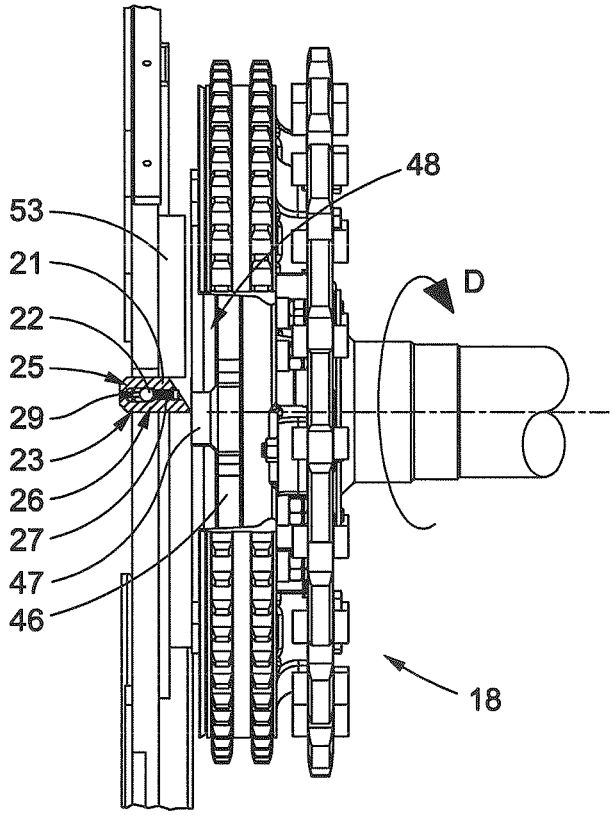
FIG. 5 shows a detail view, from the viewing direction B indicated in FIG. 3, of the deflecting wheel pair and the safety brake, wherein the locking member thereof is illustrated in a collision setting.
Figure 6:
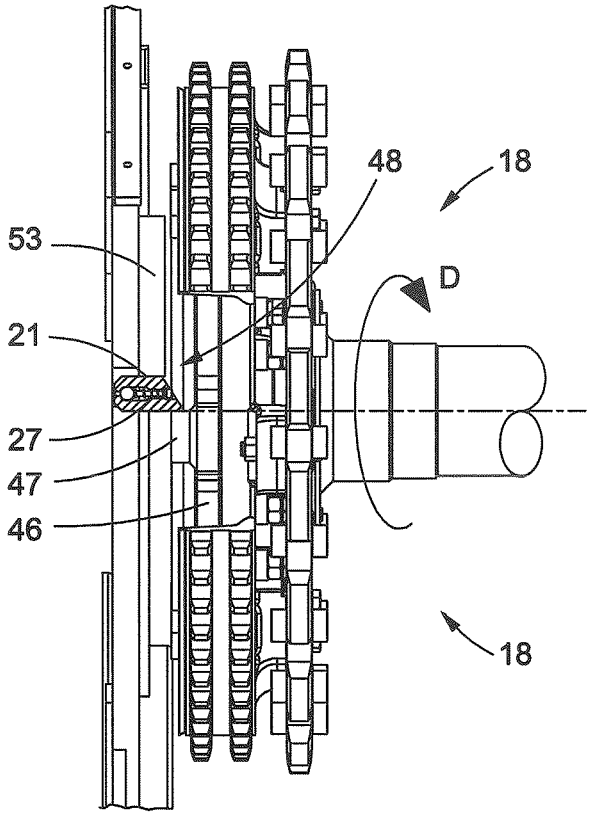
FIG. 6 shows a detail view, from the viewing direction B indicated in FIG. 3, of the deflecting wheel pair and the safety brake, wherein the locking member thereof is illustrated in a locking setting.

FIGS. 4 to 6 all show a detail view from the viewing direction B indicated in FIG. 3, wherein FIGS. 4 to 6 show different operational states of the locking member 21 and thus of the safety brake. Since only the region of the locking member 21 and the co-operation thereof with the second deflecting wheel pair 18 are to be described in more detail, merely one half of the deflecting wheel pair 18 is illustrated. In addition, in FIGS. 4 to 6 the gearwheel 44 is illustrated in broken-away form so that the locking member 21 and the projections 47 of the collar 46 are visible. Moreover, the locking member 21 is illustrated in sectional form so that the function of the resilient element 27 can be seen.

FIG. 4 shows the locking member 21 of the safety brake in the release setting. The resilient element 27 holds the locking member 21 in the first position 25, i.e. so that the locking member 21 in the first position 25 bears against the pivot axle 22. A projection 47 of the collar 46 is disposed in the region of the locking member 21 and can move past this unhindered in a predetermined direction D of rotation. It is apparent from FIG. 1 that in the case of emergency the forward run V of the step belt or the plate belt should be prevented from movement from the second story E2 in the direction of the first story E1. The predetermined direction D of rotation therefore corresponds with this direction of movement of the forward run V.

FIG. 5 shows the locking member 21 in pivoted or swiveled-in position, wherein it bears against the abutment 53. At the trigger instant of pivotation a projection 47 was by chance located in the region of the locking member 21. This impinged on this projection 47 and would jam with it if, as not illustrated, the locking member 21 were to be linearly displaceable relative to the pivot axle 22. The locking member 21 is prevented by the projection 47 from penetration into the defined space 48 and as a consequence of the collision with the impinged projection 47 has been pushed back by this into the second position 26. This means that through the pushing-back of the locking member 21 the relative position of the pivot axle 22 starting from the first position 25 changes towards the second position 26. As a result, the projection 47 can, notwithstanding the pivoted locking member 21, move past this.

The slot 23, which serves as a linear guide and enables linear displacement of the locking member 21 relative to the pivot axle 22, can be seen particularly clearly in FIG. 5. Equally the plunger-shaped element 29, which was pushed through the bore of the pivot axle 22, can be seen. The resilient element 27 is stressed by the plunger-shaped element 29 and the locking element 21 being pushed back. As soon as the projection 47 has moved past the locking member 21 and frees this the locking member 21 is displaced by the stressed resilient element 27 from the second position 26 to the first position 25 so that the locking member 21 penetrates into the defined space 48.

FIG. 6 shows the locking member 21 in pivoted position and after it could penetrate into the defined space 48. The locking member 21 has now reached the locking setting and is supported by the abutment 53. A projection 47 of the collar 46 stands against the locking member 21 and is mechanically positively blocked by this in the direction D of rotation. The locking member 21 thus prevents the projection 21 and thereby the deflecting wheel pair 18 from further rotational movement in the rotational direction D.

Figure 7:
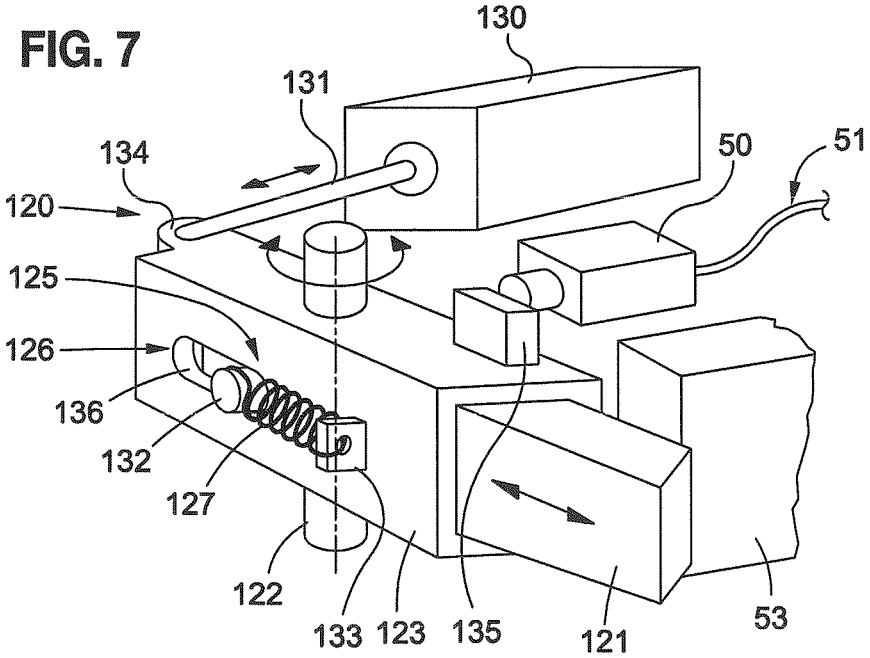
FIG. 7 shows, in three-dimensional view, a further form of embodiment of the safety brake.

FIG. 7 shows a further embodiment of a safety brake 120 in three-dimensional view. Of the escalator or moving walkway, only the abutment 53 is illustrated. The safety brake 120 comprises a locking member 121 which is guided in a tube 123, which serves as linear guide, to be linearly displaceable. The tube 123 has, for example, a square tube cross-section. Other tube cross-sectional shapes are also possible. Arranged at the tube 123 is a pivot axle 122, the bearing points of which for pivotable mounting are formed at a support structure (not illustrated) of an escalator or a moving walkway. In order to pivot the locking member 121, an eye 134, which is connected by means of a linkage 131 with a pneumatic cylinder serving as actuating element 130, is arranged at the tube 123.

The tube 123 also has a slot 136, through which a transverse pin 132 fixedly connected with the locking member 121 projects. The locking member 121 can thus be moved or linearly displaced, limited by the length of the slot 136, between a first position 125 and a second position 126. The tube 123 additionally has a strap 133. Arranged between this and the transverse pin 132 is, as resilient element 127, a tension spring which positions the locking element 121 in the illustrated, first position 125.

Moreover, a switching cam 135, which in the illustrated locking setting actuates a switching element 50, is formed at the tube 123. This switching element 50 interrupts the energy feed 51 to the drive unit 1 as explained further above in the description of FIG. 1.

Although the disclosed technologies have been described by the illustration of specific embodiments on the basis of an escalator, this can also be used in a moving walkway and numerous further variants of embodiment can be created with knowledge of the present disclosure. For example, it is apparent from FIGS. 1 to 7 that the safety brake 20, 120 can be blocked only in one rotational direction D of the deflecting wheel pair 17, 18. However, it is possible to arrange a second safety brake 20, 120 in mirror symmetry with respect to the illustrated safety brake 20, 120 so that the deflecting wheel pair 17, 18 can also be stopped in the rotational direction opposite to the rotational direction D. Moreover, the two deflecting wheel pairs 17, 18 can also be each equipped with one safety brake or two safety brakes 20, 120. However, a deflecting curve can also be arranged in the first deflecting region in place of the first deflecting wheel pair 17.

In particular embodiments, the safety brake 20, 120 is light, simple in construction and economic. Manipulation is very simple and few steps are needed in order to mount and demount the safety brake 20, 120. Moreover, the safety brake 20, 120 can be very rapidly reset after use. In addition, the safety brake 20, 120 can be used several times per day. Beyond that, the shutdown time of the escalator or the moving walkway is substantially shortened and the operator obtains significant added value or a considerable amount of additional use.

As described, various embodiments can be used on escalators or travelling stairways and moving walkways or moving sidewalks.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. A safety brake for an escalator or a moving walkway, the safety brake comprising:

a locking member, the locking member being configured to adopt a release setting or a locking setting through a pivot movement about a pivot axle, the locking member being configured to, in the locking setting, engage and block a moved part of the escalator or of the moving walkway;

a linear guide, the linear guide being mounted on a stationary part of the escalator or of the moving walkway by the pivot axle, the linear guide being configured to linearly guide the locking member, relative to the pivot axle, between first and second positions; and a resilient member being arranged between the pivot axle and the locking member, the resilient member positioning the locking member relative to the pivot axle in the first position.

2. The safety brake of claim 1, the locking member comprising an abutment surface, the abutment surface being supported in the locking setting at an abutment arranged at the stationary part.

3. The safety brake of claim 1, the locking member comprising a passage in which the resilient member is arranged.

4. The safety brake of claim 1, the resilient member being arranged at an outer side of the locking member.

5. The safety brake of claim 1, the linear guide being positioned in the locking member.

6. The safety brake of claim 1, the linear guide being arranged at an outer side of the locking member.

7. The safety brake of claim 1, further comprising an actuator, the actuator being configured to pivot the locking member about the pivot axle from the release setting to the locking setting.

8. The safety brake of claim 7, the actuator comprising a spring-loaded electromagnet, a pneumatic cylinder, a hydraulic cylinder, an electric motor, a setting motor, a step motor, or a servomotor.

9. The safety brake of claim 1, the locking member being configured to actuate a switch, the switch being configured to interrupt a current line of a drive unit of the escalator or of the moving walkway.

10. An escalator or moving walkway, comprising:

a stationary part, the stationary part comprising a support structure with a first deflecting region and a second deflecting region, and a moved part, the moved part comprising a deflecting wheel pair rotatably mounted in the second deflecting region;

an endless step belt or plate belt, the step belt or plate belt being arranged between the first and second deflecting regions and deflectable by the deflecting wheel pair; and a safety brake, the safety brake comprising, a locking member, the locking member being configured to adopt a release setting or a locking setting through a pivot movement about a pivot axle, the locking member being configured to, in the locking setting, engage and block the moved part, a linear guide, the linear guide being mounted on the stationary part by the pivot axle, the linear guide being configured to linearly guide the locking member, relative to the pivot axle, between first and second positions, and a resilient member being arranged between the pivot axle and the locking member, the resilient member positioning the locking member relative to the pivot axle in the first position.

11. The escalator or moving walkway of claim 10, further comprising a collar with projections, the collar being arranged laterally at the deflecting wheel pair, the locking member obstructing at least one of the projections when the locking member is in the locking setting.

12. The escalator or moving walkway of claim 11, the pivot axle of the locking member being arranged orthogonally to an axis of rotation of the deflecting wheel pair.

13. The escalator or moving walkway of claim 11, the collar being rotatable relative to the deflecting wheel pair, the escalator or moving walkway further comprising a slip clutch between the deflecting wheel pair and the collar.

14. The escalator or moving walkway of claim 13, the slip clutch having a settable slip torque.

15. The escalator or moving walkway of claim 14, the settable slip torque being settable elastically according to a spring characteristic or settable elastically according to a progressive spring characteristic.

16. The escalator or moving walkway of claim 10, the deflecting wheel pair being a first deflecting wheel pair, the escalator or moving walkway further comprising a second deflecting wheel pair, the second deflecting wheel pair being rotatably mounted in the first deflecting region.

17. A safety brake for an escalator or a moving walkway, the safety brake comprising:

a locking member, the locking member being configured to adopt a release setting or a locking setting through a pivot movement about a pivot axle, the locking member being configured to, in the locking setting, engage and block a moved part of the escalator or of the moving walkway; and a linear guide, the linear guide being mounted on a stationary part of the escalator or of the moving walkway by the pivot axle, the linear guide being configured to linearly guide the locking member, relative to the pivot axle, between first and second positions and being positioned in the locking member.

* * * * *